US010159877B2

(12) United States Patent
Weinmeier

(10) Patent No.: US 10,159,877 B2
(45) **Date of Patent: *Dec. 25, 2018**

(54) CUSTOMIZABLE GOLF CLUB BAG AND METHOD OF USING THE SAME

(71) Applicant: NevrLooz, LLC, Las Vegas, NV (US)

(72) Inventor: Robert Weinmeier, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/712,513

(22) Filed: May 14, 2015

(65) Prior Publication Data

US 2015/0246272 A1 Sep. 3, 2015

Related U.S. Application Data

(63) Continuation of application No. 13/934,042, filed on Jul. 2, 2013, now Pat. No. 9,079,076.

(60) Provisional application No. 61/667,791, filed on Jul. 3, 2012.

(51) Int. Cl.

| | |
|---|---|
| ***A63B 55/00*** | (2015.01) |
| ***A63B 55/40*** | (2015.01) |
| ***B65D 25/04*** | (2006.01) |
| ***B65D 25/28*** | (2006.01) |

(52) U.S. Cl.

CPC ..... *A63B 55/40* (2015.10); *A63B 55/00* (2013.01); *A63B 55/406* (2015.10); *B65D 25/04* (2013.01); *B65D 25/28* (2013.01); *B65D 25/2802* (2013.01); *A63B 2055/403* (2015.10); *A63B 2209/10* (2013.01)

(58) Field of Classification Search

CPC ..... A63B 55/00; A63B 55/04

USPC ..... 206/315.6, 315.2; 211/70.2

See application file for complete search history.

(56) References Cited

U.S. PATENT DOCUMENTS

| | | | | | |
|---|---|---|---|---|---|
| 2,091,298 | A * | 8/1937 | Agnew | A63B 55/10 | 206/315.2 |
| 2,428,853 | A * | 10/1947 | Procter | B62B 1/10 | 206/315.7 |
| 2,534,096 | A * | 12/1950 | Zapoleon | A63B 55/00 | 206/315.6 |
| 2,590,154 | A * | 3/1952 | Burns | B62B 1/262 | 206/315.2 |
| 2,676,710 | A * | 4/1954 | Williamson | B62B 1/262 | 211/70.2 |
| 4,111,248 | A * | 9/1978 | Leichhardt | A63B 55/00 | 206/315.6 |

(Continued)

*Primary Examiner* — Sue A Weaver

(74) *Attorney, Agent, or Firm* — FisherBroyles, LLP; Rob L. Phillips

(57) ABSTRACT

A golf club bag frame includes an upper portion, lower portion and central portion. The upper portion, lower portion and central portion are generally defined by a pair of side frame members joined by multiple horizontal members. The side frame members each include a curved section forming the central portion. A separator is attached to one or more of the horizontal members and includes three vertical walls and several horizontal cross-members which define multiple golf club receptacles. A handle is connected to the side frame members and/or horizontal members. A skin formed of a single piece of material which fits onto, and attaches to, the golf bag frame. Upper flaps of the skin fold over arms of the side frame members and attach to an underside of the skin using hook and loop fasteners (e.g., Velcro), buttons, snaps, zippers or the like.

11 Claims, 7 Drawing Sheets

(56) References Cited

U.S. PATENT DOCUMENTS

| | | | | | |
|---|---|---|---|---|---|
| 4,266,589 | A * | 5/1981 | Cochran | A63B 55/50 | 206/315.3 |
| 4,673,082 | A * | 6/1987 | Hemme | A63B 55/00 | 206/315.3 |
| 4,852,896 | A * | 8/1989 | Mills | A63B 55/00 | 206/315.2 |
| 5,366,075 | A * | 11/1994 | Mills | A63B 55/00 | 206/315.6 |
| 5,469,960 | A * | 11/1995 | Yuill | A63B 55/00 | 206/315.3 |
| 5,505,300 | A * | 4/1996 | Joh | A63B 55/50 | 206/315.6 |
| 6,244,438 | B1 * | 6/2001 | Weinmeier | A63B 55/408 | 206/315.2 |
| 6,736,264 | B2 * | 5/2004 | Yoshida | A45F 3/08 | 206/315.3 |
| 7,780,002 | B2 * | 8/2010 | Manaster | A45C 13/02 | 150/159 |
| 8,584,861 | B2 * | 11/2013 | Porath | A45C 9/00 | 206/315.2 |
| 9,079,076 | B2 * | 7/2015 | Weinmeier | A63B 55/00 | |
| 2004/0035729 | A1 * | 2/2004 | Chang | A63B 55/50 | 206/315.6 |
| 2010/0294681 | A1 * | 11/2010 | Dylina | A63B 55/406 | 206/315.6 |
| 2013/0105341 | A1 * | 5/2013 | Whitworth | A63B 55/408 | 206/315.6 |

* cited by examiner

CUSTOMIZABLE GOLF CLUB BAG AND METHOD OF USING THE SAME

CROSS REFERENCE

This application is a continuation of U.S. patent application Ser. No. 13/934,042 issued as U.S. Pat. No. 9,079,076, which claims the benefit of U.S. Provisional Patent Application No. 61/667,791, filed on Jul. 3, 2012, each of which incorporated herein by reference for all purposes.

FIELD OF THE INVENTION

The embodiments of the present invention relate to a customizable golf club carrying bag configured to retain golf clubs in an organized and accessible manner.

BACKGROUND

Golf is a very popular game. Approximately 30 million people in the U.S. play golf. The number worldwide is significantly higher. Golf requires the use of golf club bags which in most instances comprise an elongated, enclosed tubular article defining an upper opening into which the golf clubs are placed.

While golf technology has changed significantly over the years, golf club bags have remained relatively unchanged. Accordingly, it would be beneficial to develop a new golf club bag customizable while maintaining golf clubs in an organized, easy-to-locate fashion while eliminating lost golf clubs.

SUMMARY

The embodiments of the present invention are directed to a golf club bag having an open frame design and interchangeable outer skins. In one embodiment, a golf club bag frame comprises: an upper portion, lower portion and central portion defined by a pair of side frame members, said side frame members joined by multiple horizontal members, said side frame members include curved sections which collectively form the central portion; a separator having a plurality of walls attached to one or more of the horizontal members, said separator including cross-members which together with said separator walls define a series of individual golf club receptacles; and a handle attached to, and extending from, said side frame members and/or horizontal members.

In one embodiment, the frame receives a skin for covering the frame and clubs therein. The skin may take on different designs creating a customized golf club bag. In one embodiment, the skin is a single piece of material which slides onto and/or wraps around and attaches to the frame.

Other variations, embodiments and features of the present invention will become evident from the following detailed description, drawings and claims.

DETAILED DESCRIPTION

Figure 1:
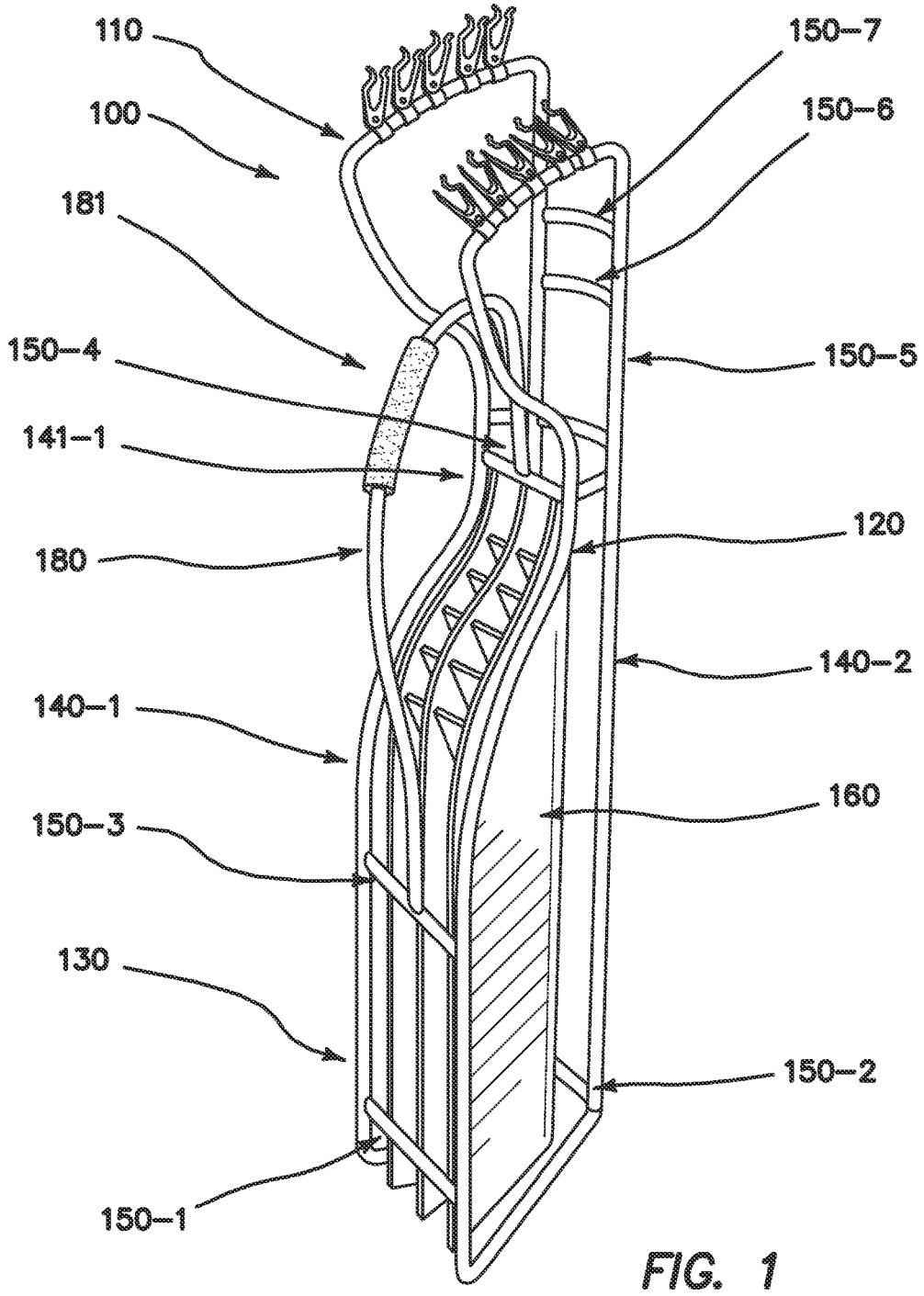
FIG. 1 illustrates a perspective view of a golf club bag frame according to the embodiments of the present invention.
Figure 2:
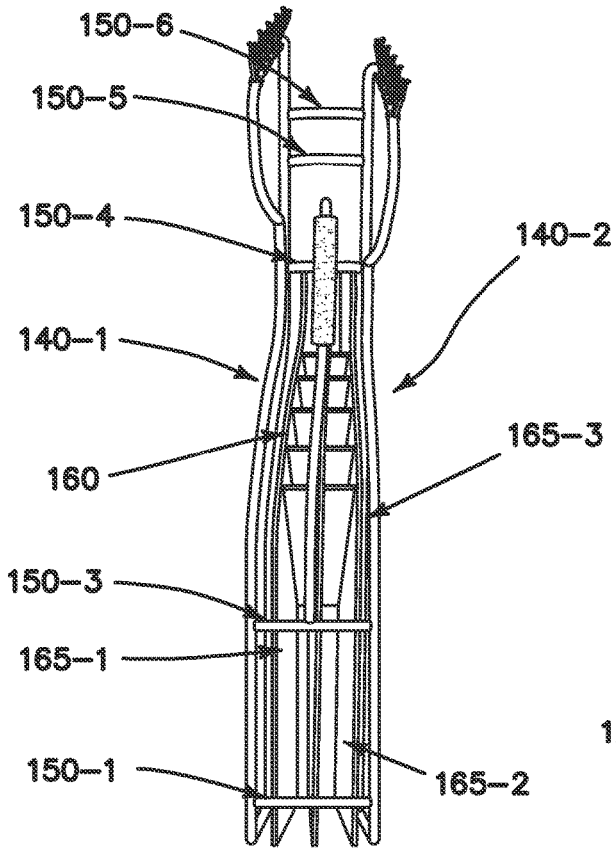
FIG. 2 illustrates a front view of a golf club bag frame according to the embodiments of the present invention.
Figure 3:
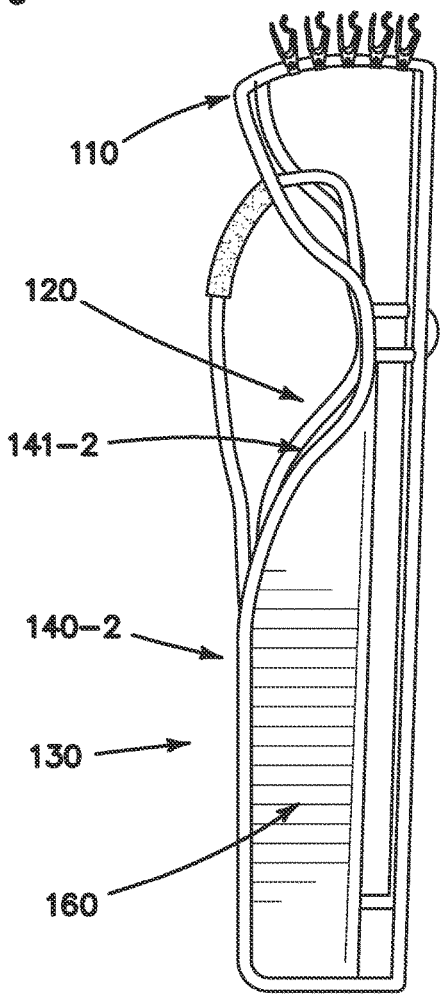
FIG. 3 illustrates a side view of a golf club bag frame according to the embodiments of the present invention.
Figure 4:
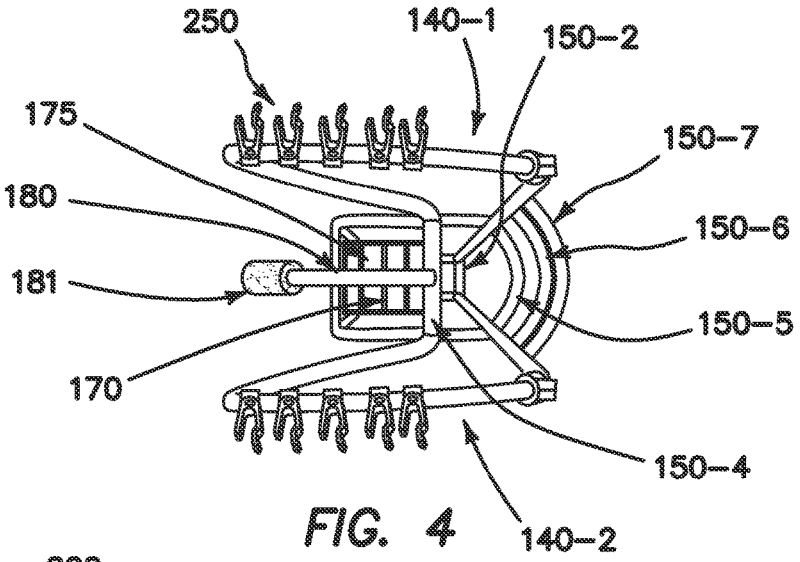
FIG. 4 illustrates a top view of a golf club bag frame according to the embodiments of the present invention.
Figure 5:
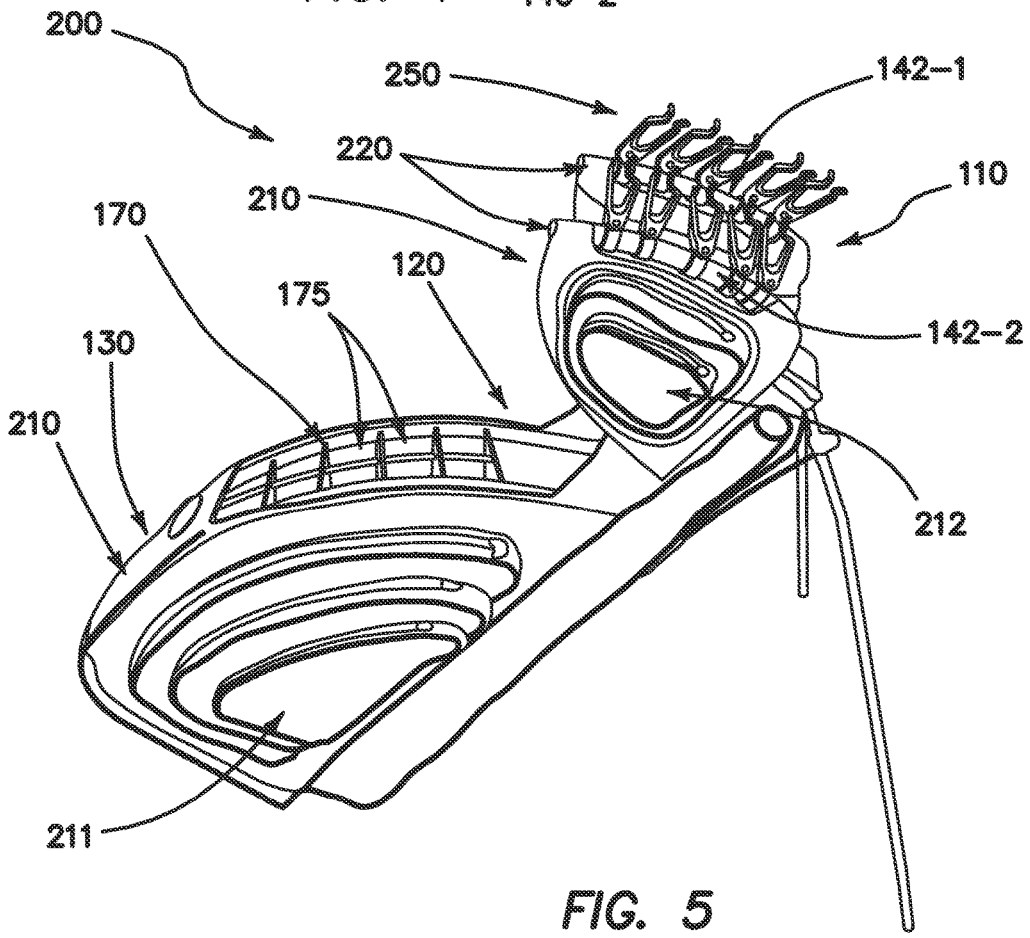
FIG. 5 illustrates a side view of a golf club bag on a stand according to the embodiments of the present invention.
Figure 6:
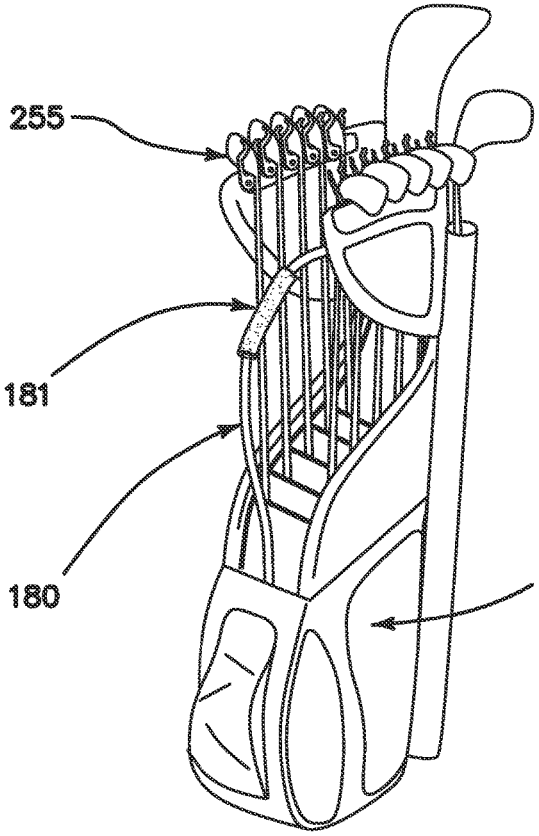
FIG. 6 illustrates a perspective view of a golf club bag with clubs according to the embodiments of the present invention.
Figure 7:
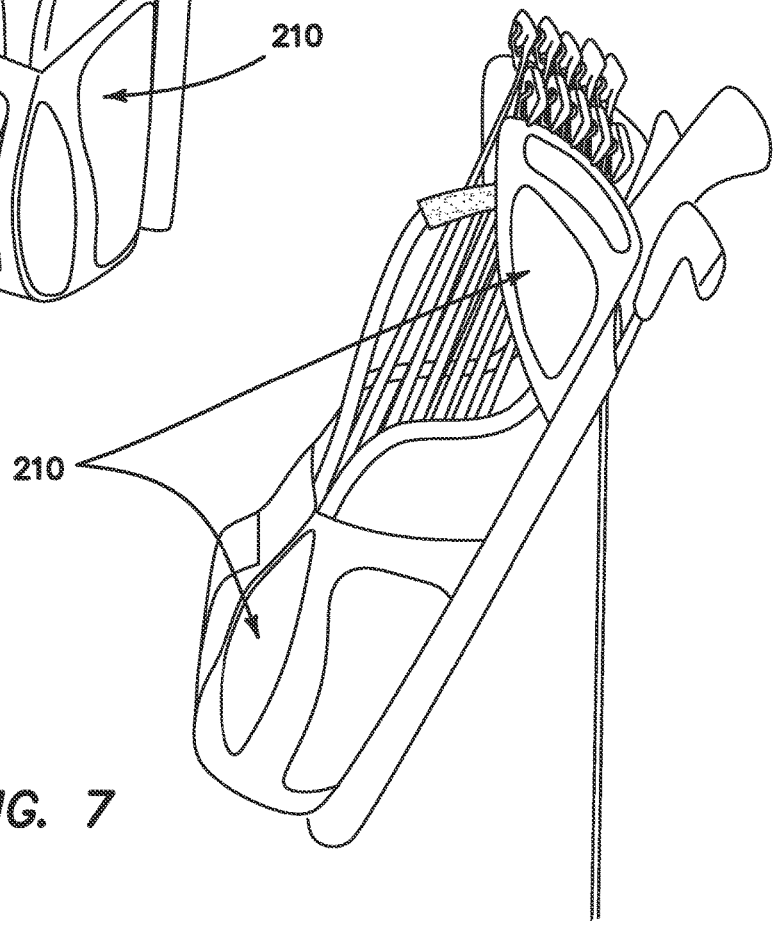
FIG. 7 illustrates a side view of a golf club bag with clubs according to the embodiments of the present invention.
Figure 8:
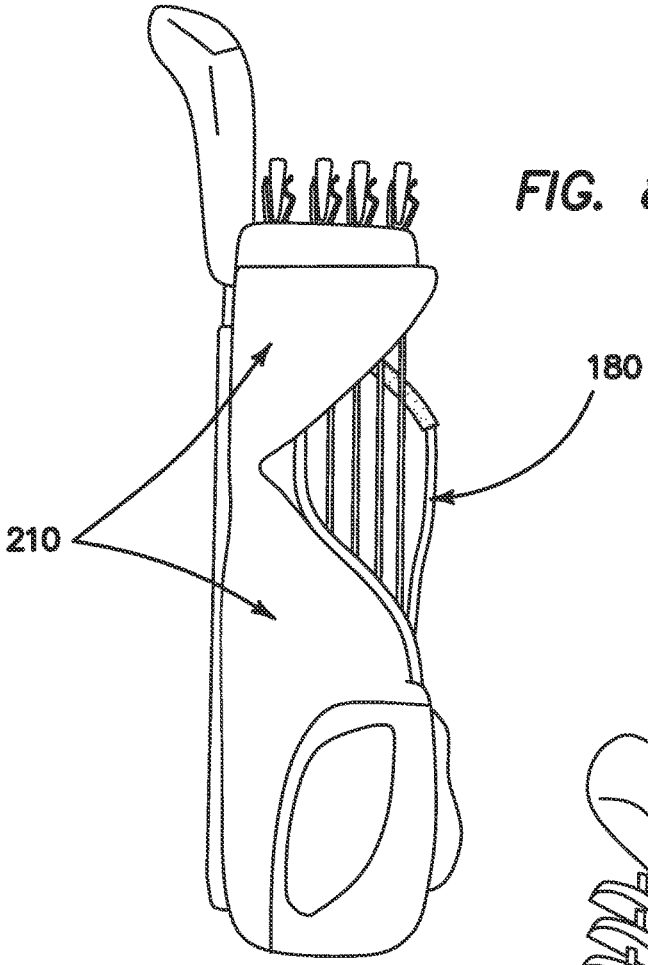
FIG. 8 illustrates another side view of a golf club carrying bag according to the embodiments of the present invention.
Figure 9:
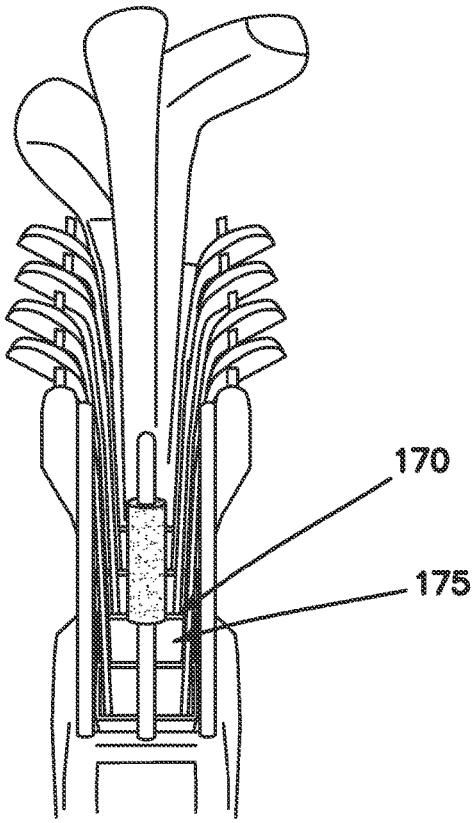
FIG. 9 illustrates an upper view of a golf club carrying bag according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIGS. 1-4 show a golf club bag frame 100 according to the embodiments of the present invention. The golf club bag frame 100 includes an upper portion 110, lower portion 120 and central portion 130. The upper portion 110, lower portion 120 and central portion 130 are generally defined by a pair of side frame members 140-1 and 140-2 joined by multiple horizontal members 150-1 through 150-7. The side frame members 140-1 and 140-2 include curved sections 141-1 and 141-2 which collectively form the central portion 120.

As shown, a separator 160 is attached to one or more of the horizontal members 150-1, 150-3 and 150-4. The separator 160 may be attached to any portion of the frame 100, including side frame members 140-1 and 140-2 and horizontal frame members 150-1 through 150-7, in any suitable manner. The separator 160 includes three vertical walls 165-1 through 165-3 and several horizontal cross-members 170 which collectively define multiple golf club receptacles 175.

A handle 180 is connected to two horizontal members 150-3 and 150-4. The handle 180 provides means for a user to carry the golf bag frame 100, skin 210 (as described below) and clubs therein. The handle 180 as shown extends proximate the central portion 120 and may include a pad 181. To provide sufficient space for the golf club bag 200 to be carried on a user's shoulder, the handle 180 extends away from the curved section 141-1 and 141-2 of the central portion 120 of the frame 100. The handle 180 may be attached to the frame 100 in any suitable manner.

The frame 100 and handle 180 may be made of any suitable material including, but not limited to, metals, alloys, plastics, composites and combinations thereof. Manufacturing the frame 100 and handle 180 may utilize machining, molding or 3D printing or combinations thereof.

Golf club clips 250 permit golf clubs 255 to be held in place. U.S. Pat. No. 6,244,438 to applicant discloses a system for holding golf clubs in a golf bag and is incorporated herein by reference for all purposes.

FIGS. 5-9 show the golf club bag 200 which comprises the golf bag frame 100, handle 180 and skin 210. In one embodiment, the skin 210 is a single piece of material which fits onto, and attaches to, the golf bag frame 100. In one embodiment, upper flaps 220 of the skin 210 fold over arms 142-1, 142-2 of the side frame members 140-1 and 140-2 and attach to an underside of the skin 210 using hook and loop fasteners (e.g., Velcro), buttons, snaps, zippers or the like. In such an embodiment, the flaps 220 are the only portions of the skin 210 physically connected to the frame 100. In other embodiments, other portions of the skin 210 may be connected to the frame 100 or itself as needed.

Figure 10:
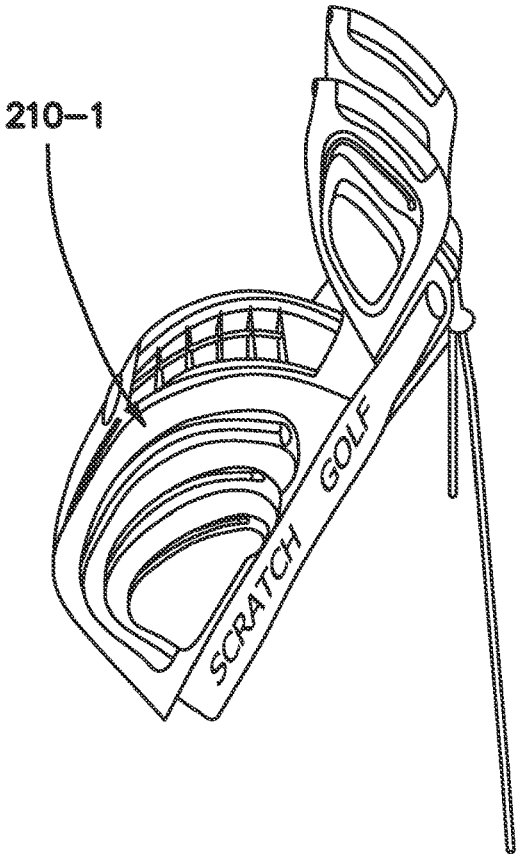
FIG. 10 illustrates a first exemplary skin on a golf club carrying bag in place according to the embodiments of the present invention.
Figure 11:
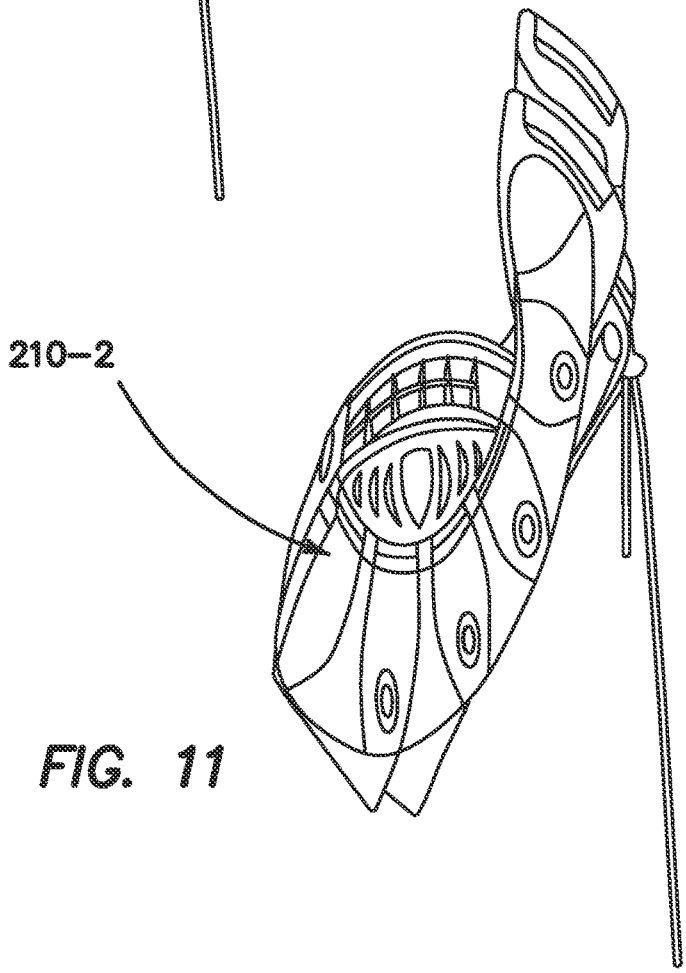
FIG. 11 illustrates a second exemplary skin on a golf club carrying bag in place according to the embodiments of the present invention.
Figure 12:
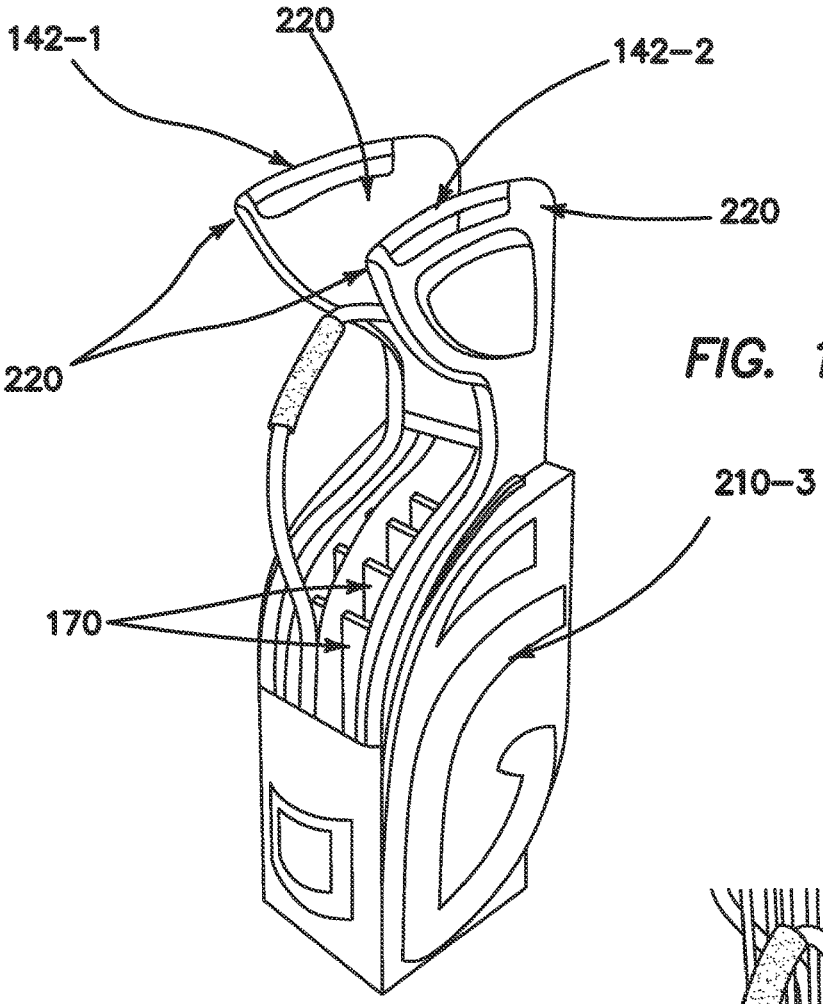
FIG. 12 illustrates a third exemplary skin on a golf club carrying bag in place according to the embodiments of the present invention.

FIGS. 10-12 show the golf club bag 200 with different skins 210-1 through 210-3. Besides different ornamental designs, the different skins 210-1 through 210-3 may incorporate compartments 211 and pockets 212 of different designs and locations on the skins 210-1 through 210-3.

Figure 13:
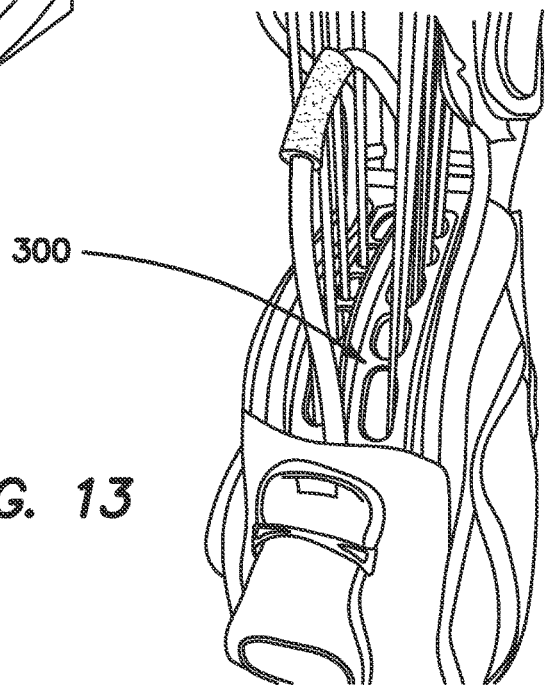
FIG. 13 illustrates a plastic and foam member for better controlling clubs within the separator according to the embodiments of the present invention.

FIG. 13 shows a plastic and foam member 300 which works with the separator 160 to maintain the golf clubs 255. The foam member 300 also protects the golf clubs 255 from damage. Those skilled in the art will recognize that other materials are suitable in conjunction with the separator 160. The separator 160 may also be fabricated of soft materials to prevent damage to the golf clubs 255.

Although the invention has been described in detail with reference to several embodiments, additional variations and modifications exist within the scope and spirit of the invention as described and defined in the following claims.

I claim:

1. A golf bag comprising:

a frame comprising:

an upper portion, lower portion and central portion defined by multiple frame members joined together;

a golf club separator positioned within said multiple frame members, said separator configured to align and retain golf clubs placed therein, said golf club separator comprising a left half and a right half;

a handle having a first end and second end, said handle attached at said first end to a first lower horizontal frame member of said frame and at said second end to a second upper horizontal frame member of said frame whereby said handle extends from said lower portion to said upper portion such that said handle extends in a vertical plane above and between said left half and said right half of said separator and any golf clubs therein; and a skin configured to removably fit onto said frame such that golf clubs placed in said golf club separator extend from said lower portion to said upper portion whereby a portion of each of said golf clubs is concealed by said skin around said lower portion and a portion of each of said golf clubs is exposed as each of said golf clubs extend through uncovered sections of said central portion and said upper portion.

2. The golf bag of claim 1 further comprising golf club clips positioned on said upper portion.

3. The golf bag of claim 1 wherein said golf club separator has three vertical walls.

4. The golf bag of claim 1 wherein said skin attaches to said frame via a pair of flaps configured to wrap around arms of side frame members among said multiple frame members.

5. A golf club bag comprising:

a frame comprising:

an upper portion, lower portion and central portion defined by multiple frame members joined together, said central portion having frame members having curved sections configured to create an open central portion;

a golf club separator positioned within said multiple frame members, said golf club separator configured to align and retain golf clubs placed therein, said golf club separator comprising a left half and a right half;

a handle having a first end and second end, said handle attached at said first end to a first lower horizontal frame member of said frame and at said second end to a second upper horizontal frame member of said frame whereby said handle extends from said lower portion to said upper portion such that said handle extends in a vertical plane above and between said left half and said right half of said separator and any golf clubs therein; and a skin configured to removably fit onto said frame such that golf clubs placed in said separator extend from said lower portion to said upper portion whereby a portion of each of said golf clubs is concealed by said skin around said lower portion and a portion of each of said golf clubs is exposed as each of said golf clubs extend through said open central portions.

6. The golf bag of claim 5 further comprising golf club clips positioned on said upper portion.

7. The golf bag of claim 5 wherein said golf club separator has three vertical walls.

8. The golf bag of claim 5 wherein said skin attaches to said frame via a pair of flaps configured to wrap around arms of side frame members among said multiple frame members.

9. A golf bag comprising:

a frame comprising:

an upper portion, lower portion and central portion defined by multiple frame members;

a golf club separator positioned within said multiple frame members, said separator configured to align and retain golf clubs placed therein, said golf club separator comprising a left half and a right half;

a handle having a first end and second end, said handle attached at said first end to a first upper horizontal frame member of said frame and at said second end to a second lower horizontal frame member of said frame whereby said handle extends from said lower portion to said upper portion such that said handle extends in a vertical plane above and between said left half and said right half of said separator and any golf clubs therein; and a skin configured to removably fit onto said frame such that golf clubs placed in said golf club separator extend from said lower portion to said upper portion whereby a portion of each of said golf clubs is concealed by said skin around said lower portion and a portion of each of said golf clubs is exposed as each of said golf clubs extend through uncovered sections of said central portion and said upper portion; and wherein golf clubs placed in said golf bag are aligned and retained by said separator and extend from a lower portion through said central portion to said upper portion where said golf clubs are held in place by multiple clips.

10. The golf bag of claim 9 wherein said golf club separator has three vertical walls.

11. The golf bag of claim 9 wherein said skin attaches to said frame via a pair of flaps configured to wrap around arms of side frame members.

* * * * *